United States Patent [19]

Nagy et al.

[11] Patent Number: 4,912,439

[45] Date of Patent: Mar. 27, 1990

[54] MOLDED CASE CIRCUIT BREAKER AUXILIARY SWITCH UNIT

[75] Inventors: Joseph G. Nagy, Plainville; Richard E. Bernier, Southington; Carin B. Benway, Elmwood, all of Conn.

[73] Assignee: General Electric Company, New York, N.Y.

[21] Appl. No.: 302,699

[22] Filed: Jan. 27, 1989

[51] Int. Cl.[4] ..... H01H 67/02

[52] U.S. Cl. ..... 335/132; 335/202; 361/426

[58] Field of Search ..... 361/426, 428; 335/132, 335/202; 200/303

[56] References Cited

U.S. PATENT DOCUMENTS

| | | | |
|---|---|---|---|
| 4,206,335 | 6/1980 | Kummerow et al. | 361/428 |
| 4,223,289 | 9/1980 | Immel | 335/132 |
| 4,297,663 | 10/1981 | Seymour et al. . | |
| 4,589,052 | 5/1986 | Dougherty . | |
| 4,591,942 | 5/1986 | Willard et al. . | |
| 4,622,444 | 11/1986 | Kandatsu et al. | 335/132 |
| 4,641,225 | 2/1987 | Reichle | 361/428 |
| 4,679,019 | 7/1987 | Todaro et al. . | |
| 4,700,161 | 10/1987 | Todaro et al. . | |
| 4,728,914 | 3/1988 | Morris et al. . | |
| 4,729,064 | 3/1988 | Singer, Jr. | 361/426 |
| 4,742,321 | 5/1988 | Nagy et al. . | |
| 4,754,247 | 6/1988 | Raymont et al. . | |
| 4,786,885 | 11/1988 | Morris et al. . | |
| 4,788,621 | 11/1988 | Russell et al. . | |
| 4,789,848 | 12/1988 | Castonguay et al. . | |

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

An integrated protection unit is a circuit breaker which includes basic overcurrent protection facility along with selective electrical accessories. A molded plastic accessory access cover secured to the integrated protection unit cover protects the accessory components contained within the circuit breaker cover from the environment. An auxiliary switch unit is one such accessory component which can be field-installed without affecting the integrity of the circuit breaker and which is connected to a remote indicator connected by external wire conductors to signal the "ON" or "OFF" condition of the circuit breaker contacts. The auxiliary switch unit enclosure is specially shaped to protect the auxiliary switch from damage due to excess tension on the external wire conductors.

10 Claims, 3 Drawing Sheets

MOLDED CASE CIRCUIT BREAKER AUXILIARY SWITCH UNIT

BACKGROUND OF THE INVENTION

The trend in the circuit protection industry is currently toward complete circuit protection which is accomplished by the addition of supplemental protection apparatus to standard overcurrent protective devices, such as molded case circuit breakers. In the past, when such auxiliary protection apparatus or other circuit breaker accessories were combined with a standard circuit breaker, the accessories were usually custom-installed at the point of manufacture. The combined protective device, when later installed in the field, could not be externally accessed for inspection, replacement or repair without destroying the integrity of the circuit breaker interior. An example of one such factory installed circuit breaker accessory is found in U.S. Pat. No. 4,297,663 entitled "Circuit Breaker Accessories Packaged in a Standardized Molded Case", which Patent is incorporated herein for reference purposes.

A more recent example of a circuit breaker including additional accessories is found in U.S. Pat. No. 4,622,444 entitled "Circuit Breaker Housing and Attachment Box" which allows the accessories to be field-installed within the circuit breaker without interfering with the integrity of the circuit breaker internal components. This is accomplished by mounting the accessories within a recess formed in the circuit breaker enclosure cover.

An electronic trip actuator which is mounted within the circuit breaker enclosure is described within U.S. Pat. No. 4,679,019 entitled "Trip Actuator for Molded Case Circuit Breakers". The circuit breaker trip actuator responds to trip signals generated by an electronic trip unit completely contained within semi-conductor chip such as that described within U.S. Pat. No. 4,589,052. The development of a combined trip actuator for both overcurrent protection as well as accessory function is found within U.S. Pat. No. 4,700,161 entitled "Combined Trip Unit and Accessory Module for Electronic Trip Circuit Breakers". The aforementioned U.S. Patents which represent the advanced state of the art of circuit protection devices are incorporated herein for reference purposes.

An integrated protection unit having both overcurrent protection along with a shunt trip accessory unit is described within concurrently filed U.S. Pat. No. 4,786,885 entitled "Molded Case Circuit Breaker Shunt Trip Unit" and U.S. Pat. No. 4,788,621 entitled "Molded Case Circuit Breaker Multiple Accessory Unit" which Patents are incorporate herein for purposes of reference.

When the integrated protection unit is located remotely from the protected industrial equipment, it is important for the equipment operator to ascertain the status of the operating power supplied to the equipment. An auxiliary switch, installed within the breaker enclosure interacts with the circuit breaker operating mechanism to provide an electronic indication of the "ON-OFF" condition of the circuit breaker contacts, usually by means of color-coded indicating lights. U.S. patent application Ser. No. 229,674 filed Aug. 8, 1988 entitled "Molded Case Circuit Breaker Auxiliary Switch Unit" describes one such auxiliary switch that is field-installable. This Application is incorporated herein for purposes of reference and should be reviewed for its description of the interaction between the auxiliary switch components and the circuit breaker operating mechanism to provide the auxiliary switch function. When such an auxiliary switch is connected by means of external wires, some means are required to prevent damage to the auxiliary switch when undue tension force is applied to the wires. U.S. Pat. No. 4,742,321 entitled "Molded Case Circuit Breaker with Accessory Functions" describes additional wire strain relief devices that are incorporated with the accessory units to protect such units from wire strain damage. This Patent is incorporated herein for reference purposes.

One purpose of the instant invention is to provide an auxiliary switch unit which is field-installable and which is capable of indicating the conditions of the circuit breaker contacts at a location remote from the circuit breaker and is protected from damage due to wire strain without requiring any additional wire strain relief apparatus.

SUMMARY OF THE INVENTION

An integrated protection unit which includes overcurrent protection along with auxiliary accessory function, contains an access cover for the selected accessory components to allow field installation of the accessory components prior to connecting the integrated protection unit within an electric circuit. One such accessory unit comprises a field-installable auxiliary switch which is installed in the circuit breaker cover. When the circuit breaker is turned on or off, the auxiliary switch unit interacts with the circuit breaker operating mechanism molded plastic crossbar to provide an output signal indicative of the "ON-OFF" condition of the circuit breaker contacts. The auxiliary switch unit enclosure contains strain relief means integrally-formed therein to protect the auxiliary switch from damage due to excess tension on the external wire conductors connected with the switch unit.

DESCRIPTION OF THE PREFERRED EMBODIMENT

Figure 1:
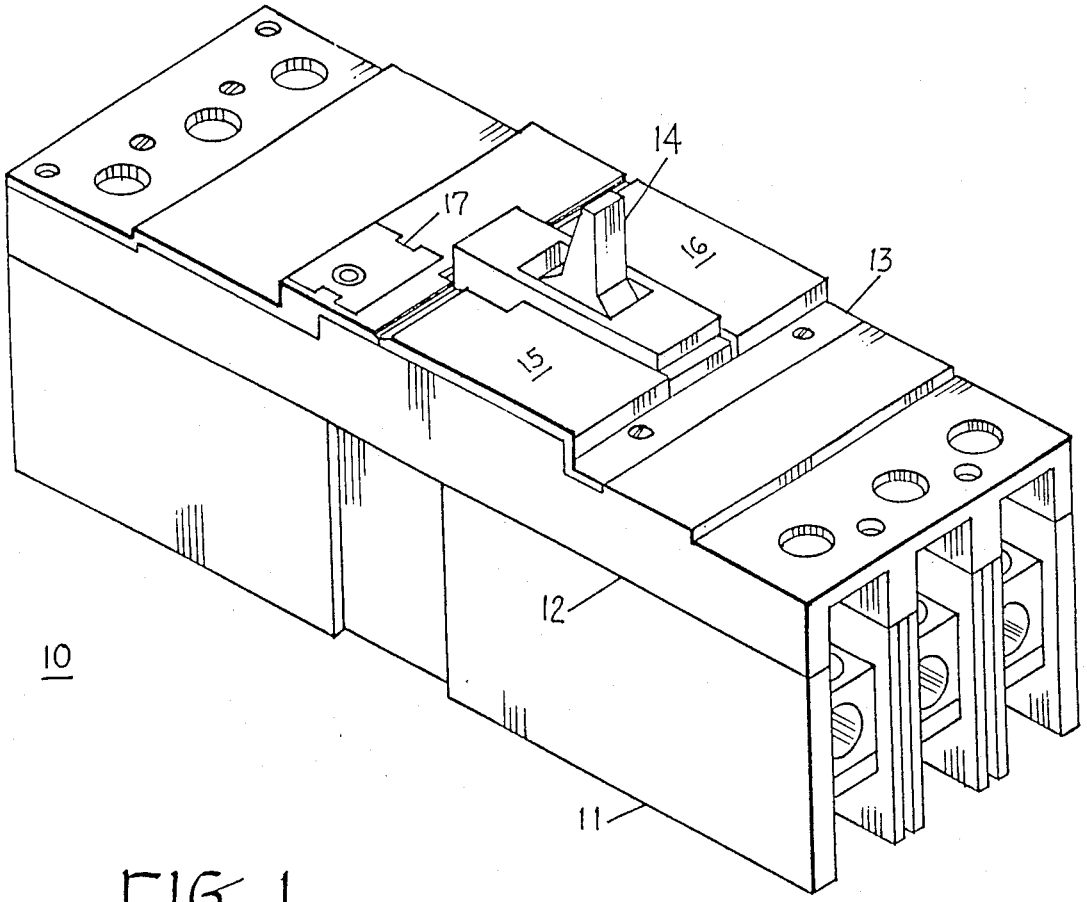
FIG. 1 is a top perspective view of an integrated protection unit containing the auxiliary switch unit according to the invention.

An integrated circuit breaker 10 consisting of a molded plastic case 11 with a molded plastic cover 12 is shown in FIG. 1 with the accessory cover 13 attached to the circuit breaker cover. The circuit breaker operating handle 14 extends up from the circuit breaker cover 12 next to the rating plug 17.

Figure 2:
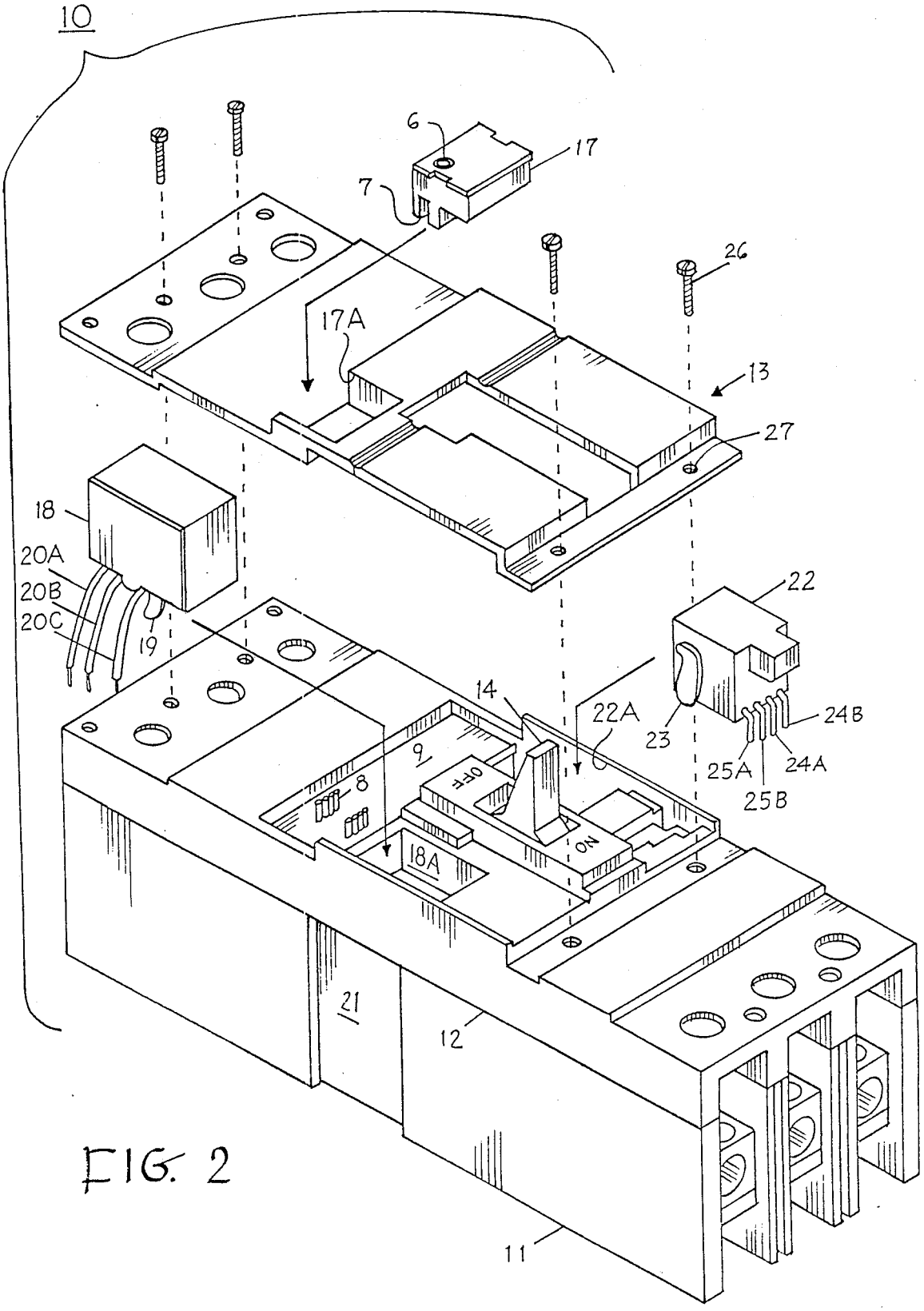
FIG. 2 is an exploded top perspective view which includes the auxiliary switch unit contained within the integrated protection unit of FIG. 1.

A pair of accessory doors 15, 16 are formed in the accessory cover for providing access to the electromagnetic actuator 22 and auxiliary switch unit 18, shown in FIG. 2. The rating plug 17 is fitted within a recess 17A formed in the accessory cover. Still referring to FIG. 2, the electromagnetic actuator 22 contains a flux shifter coil (not shown) such as described in the aforementioned U.S. Pat. Nos. 4,679,019 and 4,700,161 and is fitted with an actuator lever 23 for interrupting the circuit breaker operating mechanism (not shown). The operating mechanism is similar to that described within U.S. Pat. 4,789,848 entitled "Molded Case Circuit Breaker Latch and Operating Mechanism Assembly" which Patent is incorporated herein for purposes of reference. The electromagnetic actuator 22 within recess 22A connects with an electronic trip unit 9 by means of wire conductors 24A, 24B and with an exterior voltage source or switch (not shown) by means of a separate pair of wire conductors 25A, 25B. The trip unit 9 connects electrically with the rating plug 17 by means of pins 8 upstanding on the printed wire board and sockets 7 formed in the bottom of the rating plug. The rating plug is described in U.S. Pat. No. 4,728,914 entitled "Rating Plug Enclosure for Molded Case Circuit Breakers", which Patent is incorporated herein for purposes of reference. Access opening 6 formed on the top of the rating plug 17 allows for verifying the trip characteristics of the electronic trip unit 9. The electronic trip unit electrically connects with a current transformer (not shown) contained within the integrated circuit breaker case 11 and which is described in U.S. Pat. No. 4,591,942, which Patent is incorporated herein for purposes of reference. The integrated circuit breaker 10 depicted in FIG. 1 includes three poles, with one current transformer supplied within each separate pole. In accordance with the instant invention, an auxiliary switch unit 18 is inserted within an auxiliary switch recess 18A formed in the integrated circuit breaker cover 12 and is positioned such that a depending lever tip 19A interacts with the circuit breaker operating mechanism in the manner described within aforementioned U.S. Pat. No. 229,674. Three or more wire conductors 20A, 20B, 20C for example, electrically connect with a remote signal indicating device (not shown) such as a pair of color-coded indicating lamps to indicate the conditions of the circuit breaker contacts when the operating handle 14 is in its "ON" and "OFF" position. The accessory cover 13 is attached to the integrated circuit breaker cover 12 by means of screws 26, thruholes 27 formed within the accessory cover and threaded openings 28 formed within the integrated circuit breaker cover 12. A good description of the accessory cover 13 is found within U.S. Pat. No. 4,754,247 entitled "Molded Case Circuit Breaker Accessory Enclosure", which Patent is incorporated herein for reference purposes. The wire conductors 20A, 20B, 20C exit from the auxiliary switch unit recess 18A by means of a wiring slot or channel 21 formed in the side of the circuit breaker case 11.

Figure 3:
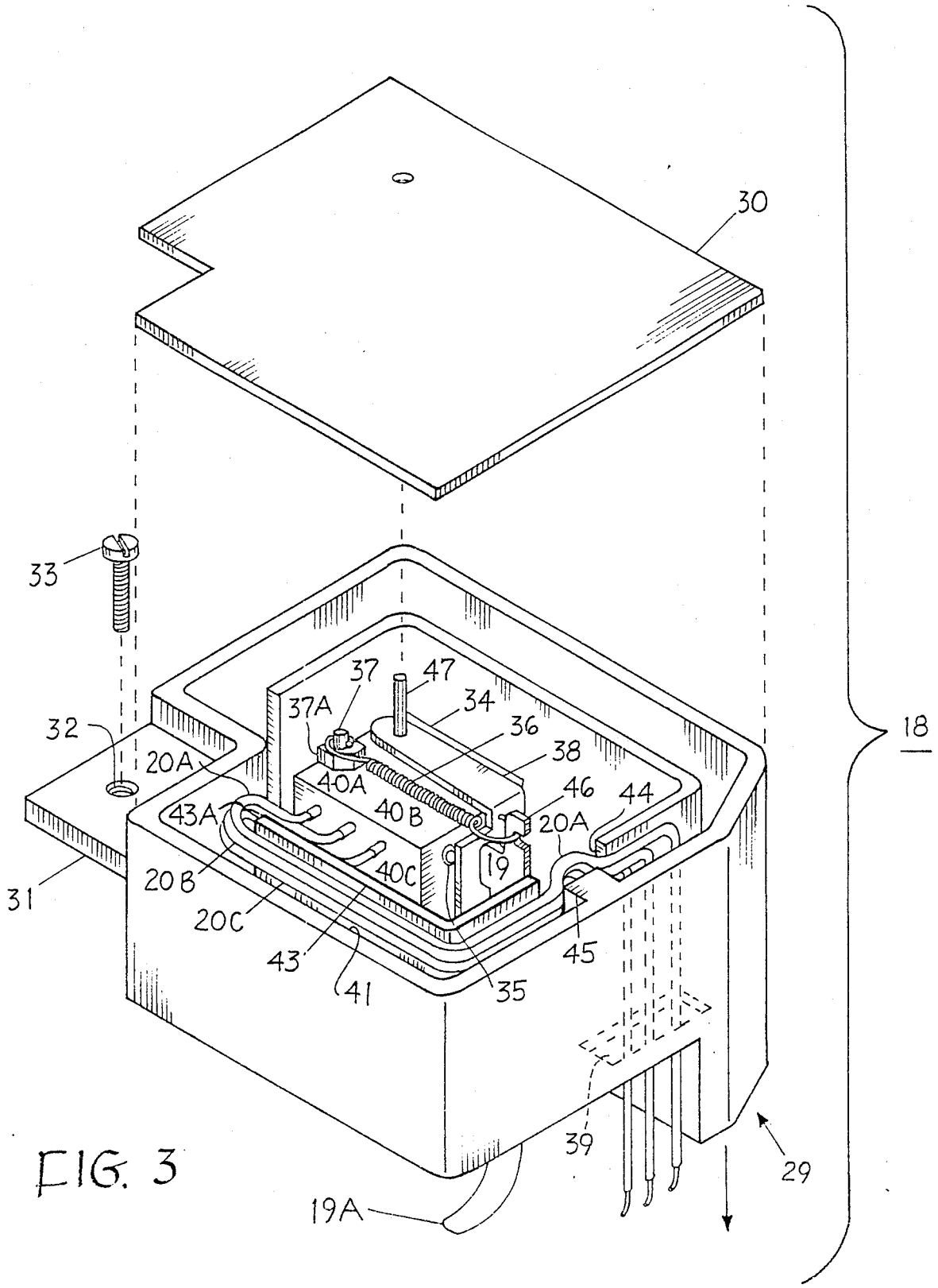
FIG. 3 is a top perspective view of the auxiliary switch unit of FIG. 2 with the cover removed to show the interior switch components.

The components within the auxiliary switch unit 18 are shown in FIG. 3 prior to assembly. The auxiliary switch unit consists of a molded plastic case 29 and a complementary molded plastic cover 30. An electric switch 34 positioned within the case includes three contact blades 40A, 40B, 40C extending from the side of the electric switch which connect with the exterior signal device, described earlier, by means of the wire conductors 20A, 20B, 20C which exit through the case 29 by means of an exit slot 39 formed through the bottom thereof. The auxiliary switch differs from that described within aforementioned U.S. patent application Ser. No. 229,674 in that the lever 19 includes an angulated flat plate 38 which extends over the switch button 35, and a depending lever tip 19A which interacts with the circuit breaker operating assembly. The plate can be shaped to directly contact the switch button, if so desired. The switch 34 is biased in its "ON" or "OFF" position by means of the return spring 36 which extends from a tab 46 on the lever to a post 37 and nut 37A on the top surface of the switch. The nut serves to secure the switch 34 to the housing 29. To prevent the wire conductors 20A–20C from being pulled away from the contact blades 40A–40C when a force is applied to the wire conductors exterior of the auxiliary switch case 29 in the downwardly indicated direction, a strain relief function is integrally-formed within the case in the following manner. An inner wall 43 is formed within the case intermediate the electric switch 34 and the continuous side wall 42 of the accessory unit case 29. A projection 45 is formed on the interior surface of the continuous side wall opposite a corresponding slot 44 formed within the inner wall 43. When the tension force is applied to the wire conductors 20A–20C, the wire conductors tighten against the projection 45 and hence relieve any stress that would otherwise appear at the contact blades 40A–40C. By directing the wire conductors around the edge 43A of the inner wall 43 an additional stress relief is provided by the edge of the inner wall. When excess tension is applied to the wire conductors, the wire conductors first tighten up against the projection 45 and then pull against the edge 43A of the inner wall to provide added stress relief. The wire conductors 20A–20C are aligned one over the other within the corridor 41 formed between the continuous side wall 42 of the auxiliary switch unit case 29 and the inner wall 43 formed integrally therein. Arranging the wire conductors one over the other within the corridor is a space-saving feature that is an important consideration since there is limited room available within the auxiliary switch unit recess 18A shown in FIG. 2. The auxiliary switch unit cover 30 is press-fit within a top part of the auxiliary switch case 29 by means of positioning post 47 and corresponding positioning hole 48. The completed auxiliary switch unit 18 is attached to the auxiliary switch unit recess by means of the thruhole 32 formed within the step 31 on the exterior surface of the auxiliary switch case and by means of a screw 33.

An auxiliary switch unit for an integrated circuit breaker has herein been described having wire conductor stress relief facility. The stress relief facility is obtained by integrally-forming a projection on the interior surface of the auxiliary switch unit cover which collaborates with a slot formed on an inner wall thereof with no additional wire stress relief apparatus being required.

Having thus described our invention, what we claim as new and desire to secure by Letters Patent is:

1. A circuit breaker, auxiliary switch comprising:

a molded plastic case and cover;

an electric switch within said case, said switch including an operating lever extending from a bottom of said case and biased to an "ON" or "OFF" condition by a return spring, said case comprising a continuous side wall surrounding said electric switch;

a plurality of contact blades extending from said electric switch connecting with a plurality of wire conductors exiting from said case for external connection with said electric switch an inner wall intermediate said side wall and said contact blades whereby said inner wall and said side wall define a corridor, said wire conductors being contained within said corridor; and means integrally-formed with said case for preventing disconnection of said wire conductors from said contact blades when tension force is applied to said wire conductors.

2. The circuit breaker auxiliary switch of claim 1 wherein said means comprise an extension formed on an interior surface of said side wall and a slot defined within said inner wall.

3. The circuit breaker auxiliary switch of claim 1 wherein said wire conductors exit from said case through a slot formed within a bottom surface of said case.

4. The circuit breaker auxiliary switch of claim 1 wherein said wire conductors are arranged one over the other within said corridor.

5. The circuit breaker auxiliary switch of claim 1 wherein said cover is press-fit within said case.

6. A circuit breaker comprising:

a molded plastic circuit breaker case and a molded plastic circuit breaker cover;

a pair of separable contacts within said cover under control of an operating mechanism and an operating handle for moving said contacts between closed and open positions;

an auxiliary switch unit within said case and arranged for indicating said closed and open positions of said contacts over a plurality of wire conductors extending from contact blades on an electric switch within said auxiliary switch unit; and said auxiliary switch unit being enclosed within an auxiliary switch case and an auxiliary switch cover, said auxiliary switch case including means integrally-formed therein to prevent tension on said wire conductors from separating said wire conductors from said contact blades said means comprising a projection formed on an interior surface of said auxiliary switch case.

7. The circuit breaker of claim 6 wherein said means further include an inner wall extending intermediate said interior surface and said auxiliary switch.

8. A circuit breaker comprising:

a molded plastic circuit breaker case and a molded plastic circuit breaker cover;

a pair of separable contacts within said cover under control of an operating mechanism and an operating handle for moving said contacts between closed and open positions;

an auxiliary switch unit within said case and arranged for indicating said closed and open positions of said contacts over a plurality of wire conductors extending from contact blades on an electric switch within said auxiliary switch unit; and said auxiliary switch unit being enclosed within an auxiliary switch case and an auxiliary switch cover, said auxiliary switch case including means integrally-formed therein to prevent tension on said wire conductors from separating said wire conductors from said contact blades said means comprising a projection formed on an interior surface of said auxiliary switch case, and an inner wall extending intermediate said interior surface and said auxiliary switch, and a slot formed in said inner wall opposite said projection.

9. The circuit breaker of claim 8 wherein said wire conductors extend between said inner wall and said interior surface.

10. The circuit breaker of claim 9 wherein said wire conductors are arranged one over the other.

* * * * *